US006155004A

United States Patent [19]

Earhart et al.

[11] Patent Number: 6,155,004

[45] **Date of Patent: *Dec. 5, 2000**

[54] PLASTIC WORKPIECE AND SHEET THEREOF

[76] Inventors: Levitt D. Earhart, 123 Santa Barbara St., Santa Barbara, Calif. 93101; Robert C. Hawley, 3072 Calle Pinon, Santa Barbara, Calif. 93105; Joseph S. Suiter, deceased, late of Palmer, Ak., by L.A. Suiter, executor

[ * ] Notice: This patent is subject to a terminal disclaimer.

[21] Appl. No.: 09/315,388

[22] Filed: May 18, 1999

Related U.S. Application Data

[63] Continuation of application No. 08/776,881, filed as application No. PCT/US95/09498, Aug. 3, 1995, Pat. No. 5,953,862, which is a continuation-in-part of application No. 08/286,866, Aug. 5, 1994.

[51] Int. Cl.[7] ..... E04C 2/30

[52] U.S. Cl. ..... 52/98; 52/217

[58] Field of Search ..... 52/98, 217; 254/104, 254/88

[56] References Cited

U.S. PATENT DOCUMENTS

| | | | |
|---|---|---|---|
| 2,772,596 | 12/1956 | Trussell | 85/50 |
| 4,817,794 | 4/1989 | Workman | 206/372 |
| 5,163,255 | 11/1992 | Gamba | 52/98 |
| 5,853,838 | 12/1998 | Siems et al. | 428/43 |
| 5,953,862 | 9/1999 | Earhart et al. | 52/98 |

*Primary Examiner*—Christopher T. Kent
*Attorney, Agent, or Firm*—Leo F. Costello

[57] ABSTRACT

A plastic shim or other workpiece useful in the construction industry. The shim or workpiece is an elongated tapered hard plastic body incorporating qualities of a shim lacking in wooden shims. Each shim has transverse break lines so that segments can be broken off to adjust its length. For handling, a plurality of such shims are molded in a sheet with adjacent shims being spaced along their thinner sections but separably joined by longitudinal, break lines extending along their thicker sections, whereby the shims can be detached from the sheet either individually or in multiples. The shims may have pockets defining nailing portions of reduced thickness which minimize the grasp of nails by the shim and allow removal of nails without damage to the shim or adjacent wood and etching to avoid uncontrolled slippage.

21 Claims, 5 Drawing Sheets

PLASTIC WORKPIECE AND SHEET THEREOF

This application is a continuation of our copending U.S. application Ser. No. 08/776,881, filed Feb. 4, 1997, now U.S. Pat. No. 5,953,862, which is based on PCT application Ser. No. PCT/US95/09498 filed Aug. 3, 1995 which in turn is a continuation-in-part of U.S. application Ser. No. 08/286,866 filed Aug. 5, 1994.

FIELD OF INVENTION

This invention pertains to plastic workpieces and particularly to plastic shims and to a sheet of such shims or like workpieces.

BACKGROUND

In the construction of buildings, tapered workpieces, such as shims, are commonly used. Shims are used to fill gaps; to level items such as doors, windows, cabinets; or to adjust such items to fit properly. In the past, shims have traditionally been made of wood, sometimes simply from scrap pieces found on the job site and fashioned by the craftsman to suit the task. In order to provide a ready supply and to overcome the inconvenience of manually creating them, manufacturers have produced wooden shims and sold them in bundles. Experience shows, however, that such manufactured shims are often not useable because of knots and cracks inherent in the secondary wood used to create them. In fact, as much as one-half of a bundle of manufactured wooden shims is generally unusable because of such defects.

Moreover, the wood used to manufacture shims is not subjected to the same quality control or care as are the better grades of wood. Although the moisture content of Grade A lumber is maintained by soaking it in water up until delivery, secondary wood usually does not receive such care and thus becomes exceedingly brittle and dry by the time it is ready for use. Shims made of such secondary wood will often split or disintegrate upon the slight impression of force needed to hammer them into a shim space.

After shims are set in a door frame or window jamb, their excess lengths must be broken off so as to allow for a uniform substrate against which to install drywall. The wooden shims in common use must be scored with a razor knife and then broken off with a hammer tap. This procedure often results in disintegration or breakage of the shims because of the poor and inconsistent quality of the wood used.

Not only does the described practice waste wood, it would be better if shims and the like were made from other materials. There are ever-increasing concerns for the preservation of forests, and thus the availability of manufactured shims and other wood products is uncertain. Still, it has not previously been recognized that conventionally shaped shims need not be made of wood but could be made of recyclable materials while improving the characteristics of the shims.

Furthermore, the handling and storing of wooden shims prior to use has not been convenient or efficient. Even manufactured bundles are cumbersome to handle and do not lend themselves to compact storage and transport, particularly after unbundling. Again, because of the quality of the wood used, wooden shims are more prone to damage while being transported and stored.

The U.S. Pat. No. 5,163,255 to Gamba provides a wooden block which is saw-cut into a plurality of wooden shims. The Gamba shims are still wood and have the disadvantages of wooden shims, as discussed above. In addition, each shim has a burr or remnant on its working face because of the wood breakage which prevents intimate mating contact with the surface or item to be leveled or adjusted. The U.S. Pat. No. 5,0554,250 to Foss provides a plastic shim, thereby avoiding the disadvantages of wood, but it is not the shape and design of the common shim which is the accepted standard for conventional construction. The U.S. patent to Trussell discloses a metal shim for use in alignment of automobile front ends, but such a shim would not be an acceptable shim for a carpenter to carry, store or use in the building trades.

SUMMARY

The present invention provides an improved plastic shim or other workpiece useful in the construction industry. Each workpiece is a tapered hard plastic body with a thicker section and a thinner section and has special characteristics for its intended purpose. Thus, the workpieces are manufactured to be of uniform size and shape, of homogeneous consistency, and of dependable quality so that they do not split or break easily or unintentionally. Moreover, they are of such dimensions, hardness, nailability, durability, surface friction and other characteristics as are especially suited for use as a shim or other workpiece and which overcome the disadvantages of wooden shims. Each shim has transverse breakable lines on both the thicker and the thinner sections and on opposite surfaces of such sections and may have nailing pockets in the thicker section which facilitate nailing of the shims without breakage. Further, a plurality of such workpieces are molded in a sheet with adjacent workpieces being spaced from each other along their thinner sections but being separably joined in the sheet by longitudinal, manually breakable lines extending along their thicker sections, whereby the workpieces can be readily detached from the sheet along said longitudinal breakable lines and whereby in the case of shims, segments of each shim can be readily broken off therefrom along their transverse breakable lines.

Accordingly, an object of this invention is to provide an improved plastic workpiece, such as a shim, having a tapered configuration for use in the building trades.

Another object is to provide a shim which is of uniform size and shape, of homogeneous consistency, of dependable quality so that it does not split or break easily or unintentionally, and of such dimensions, hardness, nailability, durability, surface friction and other characteristics as are especially suited for use as a shim or other workpiece and which overcome the disadvantages of wooden shims.

A further object is to provide sheets of plastic shims or other workpieces wherein the sheets are convenient and durable for transport, storage and handling and can be neatly, cleanly, and easily separated into individual workpieces when ready for use and so that their work surfaces are flat and unencumbered with break-off fragments.

Still another object is to enable segments of a plastic shim to be neatly and cleanly broken or snapped off manually or with a hammer to enable the shim to be shortened to a desired length.

Another object is to provide a shim which can be tapered to a feathered, nearly sharp edge, while retaining sufficient strength to maintain its integrity in during transport, storage and use.

An additional object is to provide a sheet of plastic shims which can readily be broken lengthwise of the shims for separating the shims from the sheet and transversely of the shims for shortening the shims to a desired length, and yet to provide shims that are solid and durable and do not splinter or break in their intended uses.

Another object is to provide a sheet of plastic workpieces, such as shims, which can be broken off in single units if single narrower workpieces are needed or in multiple units if wider workpieces are needed.

A still further object is to provide transverse break lines in opposite surfaces of shims so that the shims can be paired and cleanly broken as a pair.

Another object is to prevent the flat working surfaces of a plastic shims from slipping in place before being nailed.

Another object is to provide shims which can operate efficiently in pairs in that they are of uniform size and shape and have complementary flat surfaces with the appropriate degree of friction in contact each other and with items being shimmed to allow necessary sliding and avoid unacceptable slippage.

Yet another object is to provide a plastic shim through which a nail can be driven into wood and subsequently removed without damaging the shim or the wood.

A further object is to provide shims and like workpieces which are not made of wood but of recyclable material and thereby help to preserve the forests.

These and other objects will become apparent from the accompanying drawings and the description which follows.

DETAILED DESCRIPTION

Figure 1:
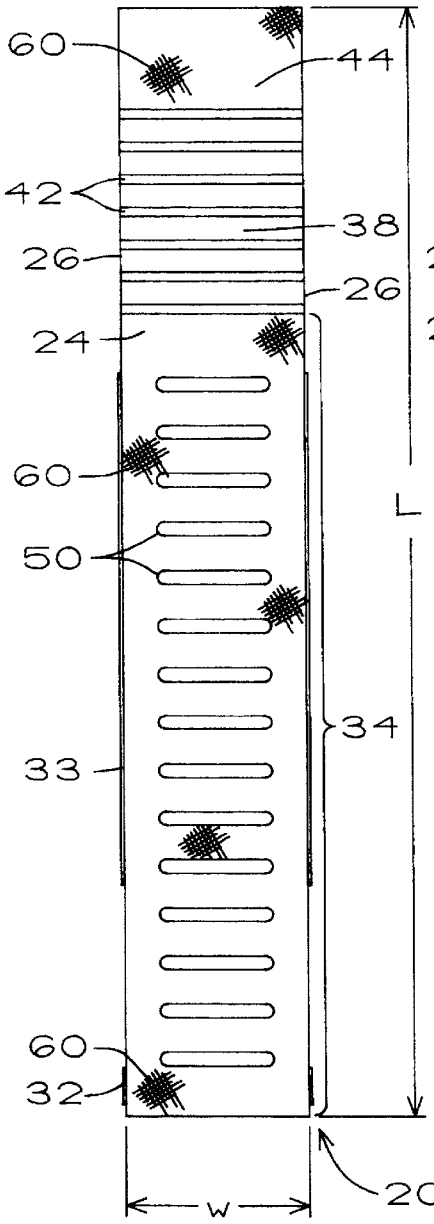
FIG. 1 is a plan view of the back surface of a shim in accordance with the present invention.
Figure 2:
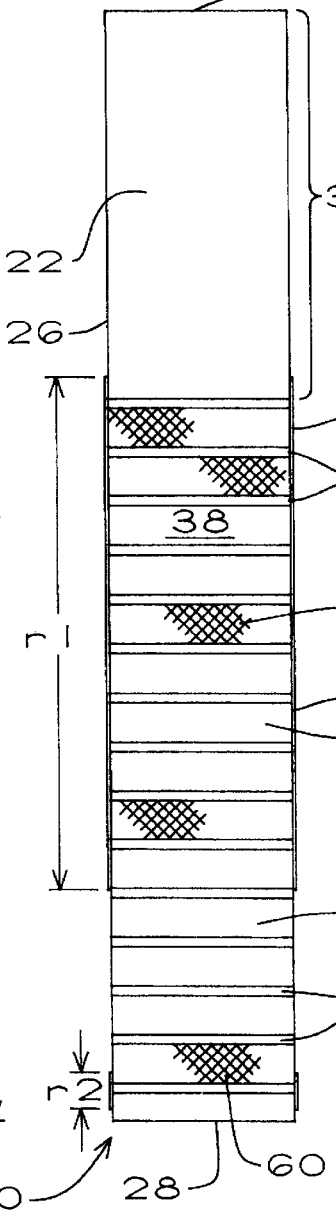
FIG. 2 is a plan view of the front surface of the shim shown in FIG. 1.
Figure 3:
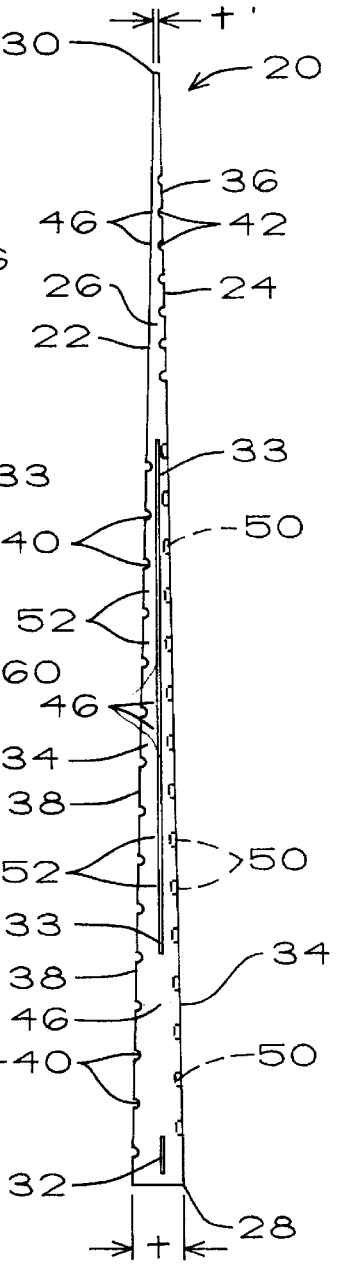
FIG. 3 is a side elevation of a shim of the shim shown in FIG. 1.

Referring to FIGS. 1–3, the principles of the present invention are incorporated in a shim which is shown and identified by the numeral 20. The shim is molded of plastic material such as polystyrene, impact polystyrene or polypropylene and is hard, durable, of high strength and impact resistance, and of homogeneous consistency. The shim has opposite flat, rectangular front and back shimming surfaces 22 and 24, side edges 26, a rearward hammer end 28, and a forward insertion end 30. Short and long rib fragments 32 and 33 project almost imperceptibly from the side edges, for a reason to be described.

With particular reference to FIG. 3, the shim 20 is gradually and uniformly, linearly tapered from the rearward end 28 to the forward end 30, the later being referred to as a feathered end because of its thinness and nearly sharp edge. It is descriptively convenient to refer to the shim as having a thicker rearward section 34 and a thinner forward section 36. There is no discrete boundary between such sections but a short "overlap", it being understood that the shim is molded in one piece. The rearward section 34 extends from the rearward end 28 past the center of the shim (approximately ⅝th of the length of the shim in the preferred embodiment). The forward section 36 slightly overlaps the rearward section and extends therefrom to the forward end 30 (approximately ⅜th of the length of the shim in this preferred embodiment). Although proportions very close to those stated are preferred, the exact division between these sections is not critical.

It is significant, however, that the forward section 36 is very thin and yet exhibits high strength and resilient flexibility. As an example, in the preferred embodiment, the shim is 1.170 in (2.97 cm) in width, the forward section is 2.950 in (7.49 cm) long and tapers from about 0.11 in ( 0.28 cm) at the ⅝th-⅜th border to 0.032 in (0.08 cm) at the forward end 30. With these dimensions, the forward section can be flexed relative to the rearward section 34, like a cantilever, in both directions out of its normal coplanar relation with the rearward section by more than 1 in (2.54 cm) and return to such coplanar relation without breaking and with no deformity. Notwithstanding this strength, such thinness allows the shim to fit into narrow shim spaces and facilitates the controlled breaking described below.

Figure 7:
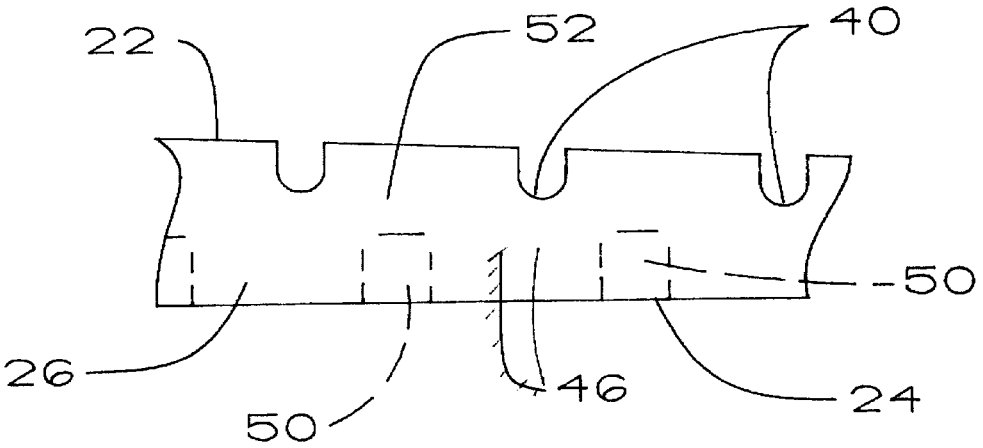
FIG. 7 is an enlarged fragmentary view of a side edge of the shim of FIGS. 1–3.

The rearward section 34 has a plurality of U-shaped grooves 40 (FIGS. 2, 3 and 7) in the front surface 22. These grooves are equally spaced lengthwise of the shim 20 and extend transversely thereof. As best shown in FIGS. 3 and 7, the depth of these grooves gradually varies from a maximum (about 0.050 in or, 0.013 cm in the preferred embodiment) at the rearward end 28 to a minimum at the forward end of the rearward section. Also, the forward section 30 has a plurality of U-shaped grooves 42 (FIGS. 1 and 3) in the back surface 24, and these grooves are equally spaced lengthwise of the shim and extend transversely thereof. The depth of these grooves varies from a maximum at the rearward end of the forward section to a minimum adjacent to the forward end 30. The spacing of all of the grooves in each section is uniform, as shown.

The forward and rearward grooves 40 and 42 (FIGS. 1 and 2) thus define or create a pattern in their respective surfaces 22 and 24 of a plurality of small rectangular segments 38 most of which are of uniform length and width except for the forwardmost segment on each surface. The narrower forwardmost segment 44 on the back surface 24 is not grooved because of the thinness of the shim at that location, whereas the front surface 22 of the forward section 36 is not grooved so as to provide an area for a logo, advertising material, or other indicia. With reference to FIG. 3, it will be noted that where the forward and rearward sections "overlap," there is an absence of grooves on both the front and back surfaces. Stated otherwise, the spacing between the forwardmost groove of the rearward section and the rearwardmost groove of the forward section is approximately three times the spacing between the other grooves, thereby maintaining the strength of this "overlap" area.

The forward and rearward grooves 40 and 42 (FIG. 3) also define breakable portions 46 which are weakened areas or lines in the shim 20 to enable the segments 38 to be snapped or broken off from the remainder of the shim. As noted above, the forward section 36 is so thin that the shim can easily be manually broken off at any of its forward grooves, particularly when the entire forward section is present for leverage. This allows the craftsman to make a preliminary break if desired before inserting the shim in place. Normally, however, segments of the shim are snapped off by hammer after the shims are inserted.

Figure 8:
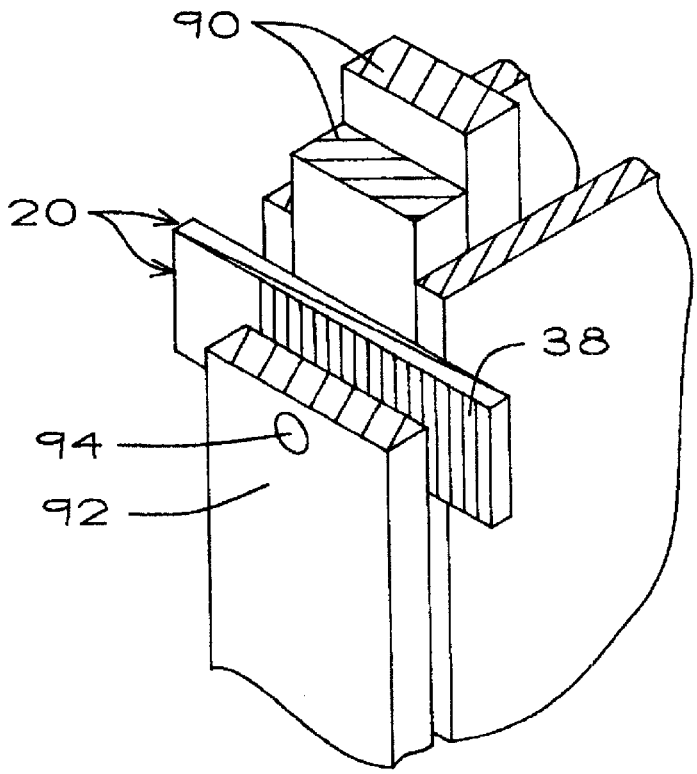
FIG. 8 is a fragmentary isometric of a pair of shims of the present invention in use.
Figure 9:
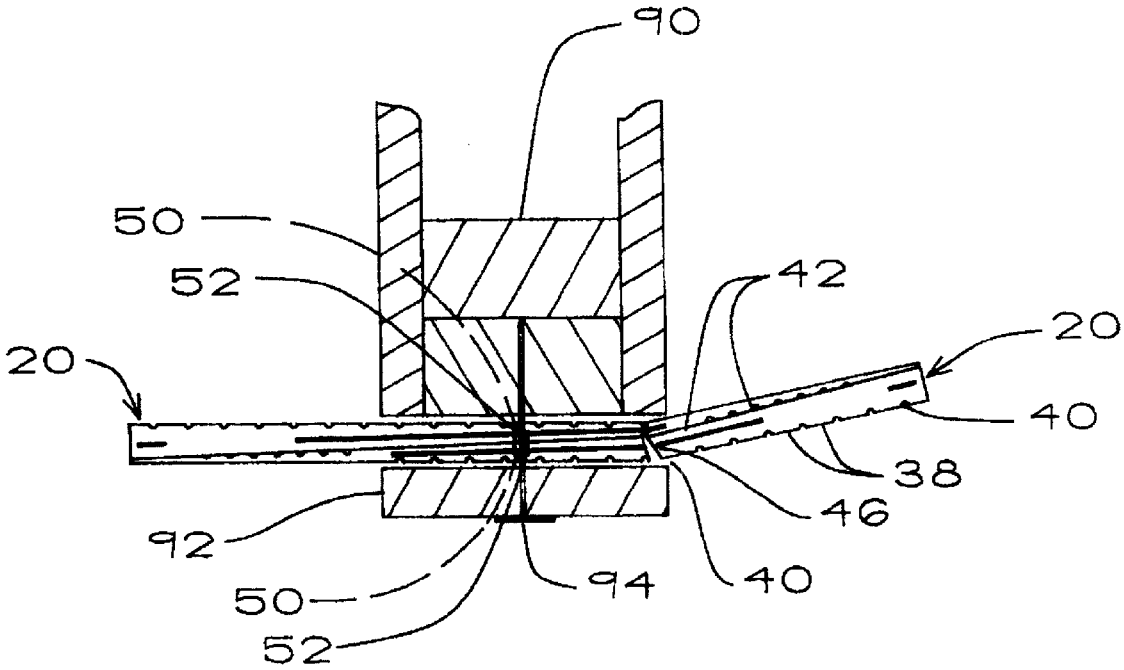
FIG. 9 is a top view of the structure shown in FIG. 8 but showing how the shims accommodate nailing and how the shims are broken in pairs.

As stated, the rearward grooves 40 (FIGS. 1 and 2) are uniformly spaced along the length of the front surface 22 of the rearward section 34 and the forward grooves are uniformly spaced along the back surface 24 of the forward section 36, and this spacing is the same in both places. Since the shims are normally used in pairs, as shown in FIGS. 8 and 9, this spacing allows alignment of opposing grooves and breakable portions 46 so that the shims can be cleanly broken as a pair.

Also in accordance with this invention, the back surface 24 (FIG. 1) of the rearward section 34 provides a plurality of oblong nailing pockets, cavities or depressions 50 which are uniformly spaced lengthwise of the shim 20 and which extend transversely thereof. With reference to FIG. 3, it will be noted that the pockets are located generally between the rearward grooves 40 on the front surface 22. In other words, each rearward segment 38 has a back pocket. Like the grooves, the pockets vary in depth from a maximum depth at the rearward end 28 to a minimum depth at the forward end of the rearward section. No pockets are provided in the forward section 36.

The purpose of these pockets 50 is to allow nails to be driven through the shim 20 and the wood parts being shimmed and then be pulled out without splintering or otherwise damaging the shim or the wood. Without the pockets, the plastic grasps the nail so tightly that in removing it during adjustment of the shims and the work being shimmed, the shim may splinter and the adjacent wood be damaged in the process. The pockets thus provide each rearward segment 38 with a nailing portion 52 (FIG. 3) of reduced thickness, that is, with less material than the full thickness of the shim. When a nail extends through a pocket and penetrates the associated nailing portion, the latter does not grasp the nail as tightly as would the full thickness of the shim.

Still further, the front and back surfaces 22 and 24 of the shim 20 (FIGS. 1 and 2) are chemically etched or striated, preferably to a depth of about 0.003 inch (about 1.18 mil), as represented at 60. It is to be understood that this etching preferably covers the full extent of the front and back surfaces, except for the logo area, but is shown only at certain locations for illustrative clarity. The purpose of this etching is provide the surfaces with a moderate degree of friction so that in use, the shims are prevented from slipping out of position while still retaining the ability to be readily and controllably slid against each other and adjacent shimmed surfaces. Because the plastic imparts such a hard, smooth finish to the shim, such etching is especially useful to achieve better control of the shims as they fit against each other in pairs or against wood.

Figure 4:
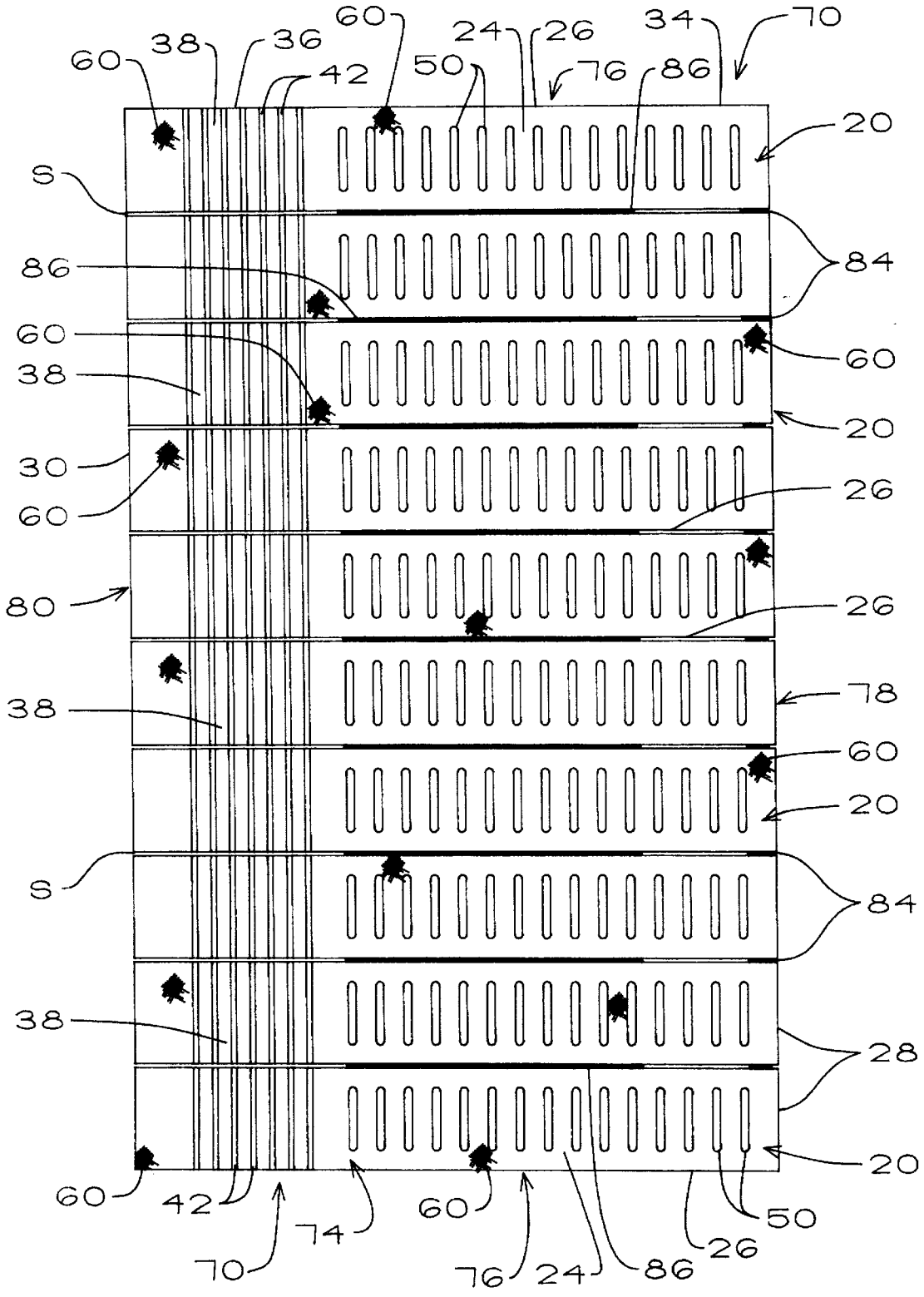
FIG. 4 is a plan view of the back surface of a sheet of the shims of the type shown in FIGS. 1–3 but with the individual shims being shown on a reduced scale from FIGS. 1–3.
Figure 5:
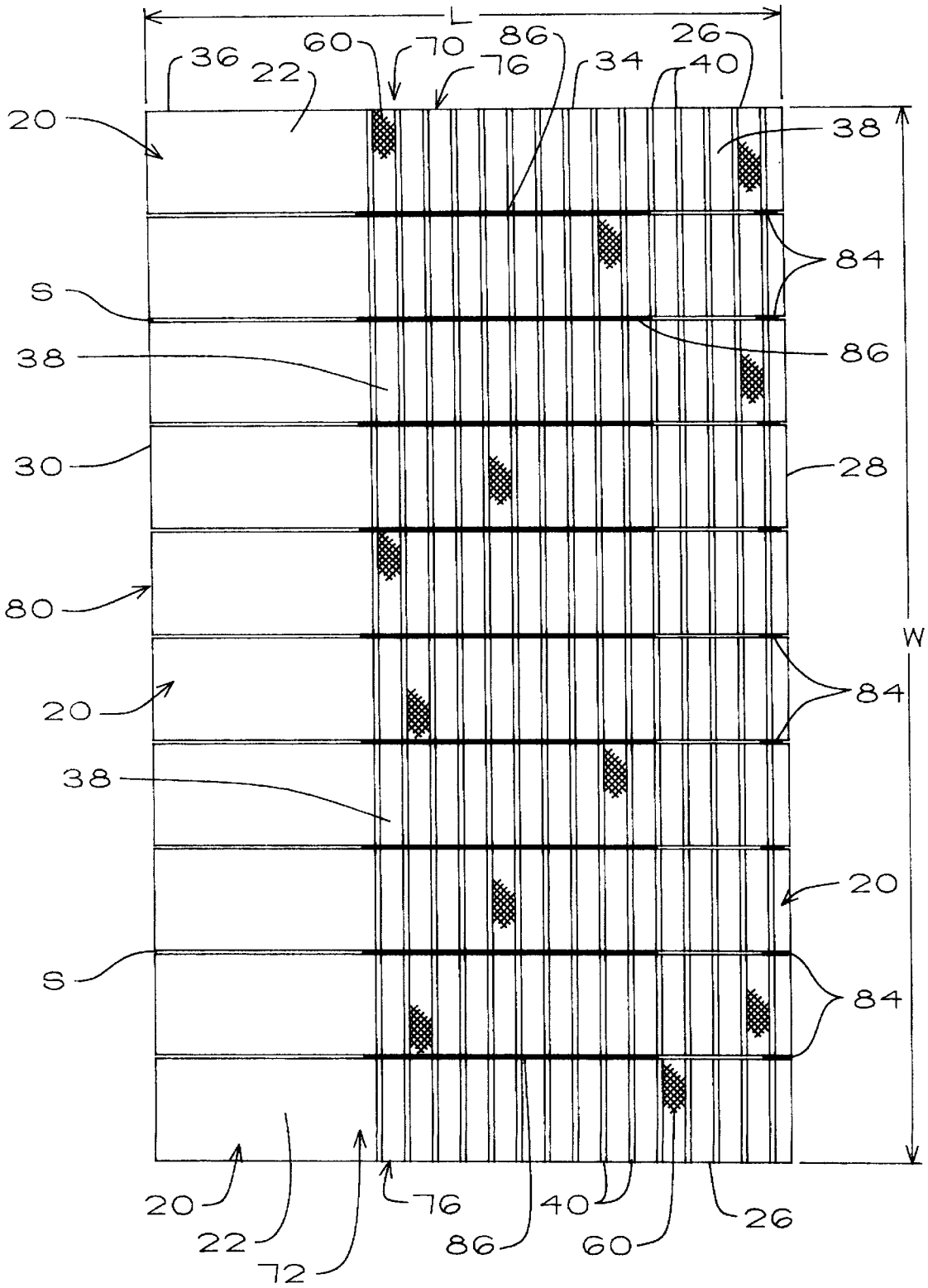
FIG. 5 is a plan view of the front surface of the sheet shown in FIG. 4.

With reference now to FIGS. 4 and 5, an important aspect of the present invention is a plastic sheet 70 of the shims 20. This sheet has opposite, flat, rectangular front and back shimming surfaces 72 and 74 which are defined by the coplanar front and back shimming surfaces 22 and 24 of the shims in the sheet. The sheet also has side edges 76, which are defined by the outer side edges 26 of the outside shims, a rearward edge 78 which is defined by the aligned rearward edges 28 of the shims, and a forward edge 80 which is defined by the aligned forward edges 80 of the shims.

Adjacent shims 20 in the sheet 70 are separably, breakably joined by short and long plastic ribs 84 and 86 (FIGS. 2–4 and 5) which are spaced from each other lengthwise of the shims. That is, each short rib is in adjacent spaced relation to the rearward edge 78, interconnects adjacent rearward sections 34 of adjacent shims, and extends from about the centerline of the rearwardmost segment 38 to about the centerline of the next adjacent segment. Each long rib extends preferably from about the sixth segment from the rearward end to the so-called overlap area of the rearward and forward sections and is thus longer than the short rib.

Figure 6:
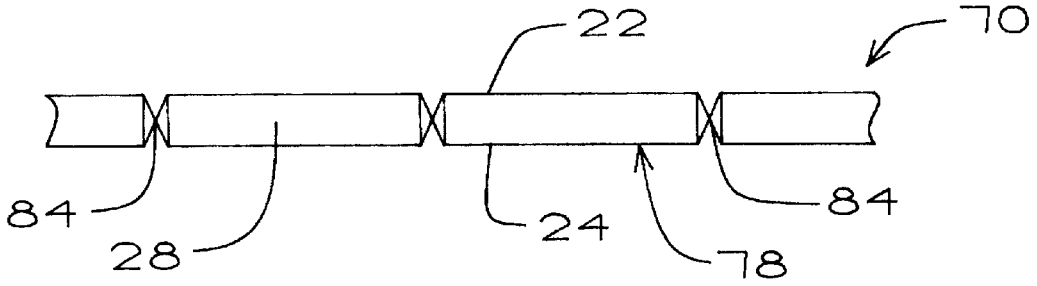
FIG. 6 is an enlarged fragmentary view of the rearward edge of the sheet of FIGS. 4 and 5.

Between the short and long ribs 84 and 86 (FIGS. 2–4 and 5) and between adjacent forward sections 36, adjacent shims 20 in the sheet 70 are closely spaced but are not connected. Such spacing facilitates breakability of the shims from the sheet while the ribs maintain sheet rigidity. Also in this regard, the thickness of each rib is less than the thickness of the shim at the place where the rib attaches, it being understood that the rib thickness tapers like the shim. In fact, to further facilitate breakability, it is preferred that the rib thickness be less than about half the thickness of the shim at the place of attachment and that the ribs be located closer to the front surface 22 than to the back surface 24, as shown in FIG. 6.

Interconnection of adjacent shims 20 by the spaced dual ribs 84 and 86 thus has several advantages. These ribs of course maintain the relatively rigid integrity of the sheet and its coplanar condition for handling, transporting, and storing of the sheets. The ribs are sufficiently strong to maintain such integrity but are weak enough to be readily broken with the application of moderate finger pressure. No ribs exist between the forward sections because of the thinness of these sections and because such absence facilitates manual break-off of the shims from the sheet. If ribs were to be provided between the forward sections, they would have be about the same thickness as the forward section so that a clean break-off line could not be established and risk of unintentional breakage of the forward section might occur.

Further, it is noted that after a shim 20 is broken off from the sheet 70 (FIGS. 4 and 5), the break along each side edge 26 is clean and neat (FIG. 2), with no splitting, splintering, or rough burrs. All that remains are the short and long rib fragments 32 and 33 which are smooth and almost unnoticeable. In any event, these rib fragments are on the side edges which do not contact the working surfaces of the items being shimmed.

Although exact dimensions are not critical to the principles of the present invention, a few of the preferred dimensions of the described embodiment have been given above and a few more are set forth below to enable a better understanding of the invention.

| Part | Dimension |
|---|---|
| L (length of sheet 70 and each shim 20) | 7.875 in (20 cm) |
| W (width of each sheet 70 of ten shims) | 11.812 in (30 cm) |
| w (width of each shim 20 including rib fragments 32 and 33) | 1.170 in (2.97 cm) |
| t (thickness at rearward end) | 0.312 in (.79 cm) |
| t' (thickness at forward end) | 0.032 in (.08 cm) |
| r1 (length of long rib) | 3.315 in (8.42 cm) |
| r2 (length of short rib 84) | 0.500 in (1.27 cm) |
| s (spacing between adjacent shims in sheet) | 0.050 in (.13 cm) |

With reference to FIGS. 8 and 9, a pair of shims 20 is shown back-to-back between studs 90 and finish wood 92 of a door frame. As the craftsman is hanging the door, he works his way around the frame, driving a few nails 94 part way in as he goes. As shown in FIG. 9, these nails fit into the pockets 50 and through the reduced portions 52 of the shims. If he has to pull out one or more nails, they slide out of the reduced portions without splitting or splintering the shim and avoid damage to the wood, especially the finish wood. Also FIG. 9 shows how the opposed grooves allow the shims to be cleanly broken as a pair.

From the foregoing, it will be understood that a plastic shim 20 has been provided which is of uniform size and shape, of homogeneous consistency, and of dependable quality so that it does not split or break easily or unintentionally. The shim is of such dimensions, hardness, nailablity, durability, surface friction and other characteristics as are especially suited for use as a shim and which overcome the disadvantages of wooden shims. Segments 38 of the shim can be neatly and cleanly broken or snapped off manually or with a hammer to enable the shim to be shortened to a desired length.

Moreover, a sheet 70 of plastic shims 20 has been disclosed which is convenient for transport, storage and handling of the shims. The sheet can be neatly and cleanly separated into individual shims when ready for use and so that the work surfaces of the shims are flat and unencumbered with break-off fragments. The joining of only the thicker sections of the shims in the sheet by the spaced ribs 84 and 86 maintains the sheet configuration while facilitating breakability. The sheet construction allows the sheet to be readily broken lengthwise of the shims for separating the shims from the sheet and allows the shims to be readily broken transversely thereof for shortening the shims to a desired length. Yet, both the sheet and the shims are solid and durable, and the latter does not splinter or break in its intended use. The sheet also provides a very convenient way of breaking off a single shim if only one is needed or multiple shims if a wider shim is needed. The entire sheet is even available as a shim if that is desired.

The invention has been disclosed in the embodiment of a plastic shim, but there are other workpieces, especially tapered ones like a stake, and other items particularly those suited for the building industry, that could equally as well incorporate the same principles. Thus, although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A shim comprising:

an elongated hard workpiece of plastic material having a generally planar, rectangular front surface and an opposite generally planar rectangular back surface, opposite side edges, opposite first and second ends, a longitudinal dimension between said first and second ends, a transverse dimension between said side edges, and a thickness dimension between the front and back surfaces, said workpiece being tapered in said thickness dimension from said first end to said second end thereby defining a thicker section adjacent to the first end and a thinner section adjacent to the second end, said workpiece having break lines extending transversely of the workpiece and spaced lengthwise thereof to divide the workpiece into transverse segments which can be broken off from the workpiece along said break lines, said plastic material and the thickness of the thinner section enabling the thinner section to be manually flexed longitudinally of the shim out of its normal coplanar relation with the thicker section and to return to said coplanar relation with no deformity and without breaking relative to the thicker section or along said break lines.

2. A shim of claim 1, wherein the break lines are grooves in the back surface and the depth of the grooves varies from a maximum adjacent to the thicker section to a minimum adjacent to the second end.

3. The shim of claim 1, wherein the break lines extend transversely of both the thicker and thinner sections.

4. The shim of claim 1, wherein the break lines are grooves in the front surface of the thicker section and grooves in the back surface of the thinner section.

5. The shim of claim 1, wherein the back surface of the thicker section has a plurality of longitudinal spaced depressions for accommodating nails to be driven through the thicker section.

6. The shim of claim 5, wherein the depressions are oblong pockets that extend transversely of the shim with the depth of the pockets gradually decreasing the closer the pocket is to the second end.

7. The shim of claim 1, wherein there is etching on the front and back surfaces.

8. The shim of claim 1, wherein the shim is molded of a plastic material selected from the group including polystyrene and polypropylene, wherein the length of the thinner section is about 7.5 cm, and wherein the thinner section varies from a thickness of about 0.28 cm relatively adjacent to the first end to about 0.08 cm at the second end.

9. A plurality of separably interconnected plastic shims, comprising:

a first, generally rectangular plastic shim having first, second, third, and fourth peripheral edges, a second, generally rectangular, plastic shim having first, second, third, and fourth peripheral edges, the first and second shims being of generally uniform size and shape with the length of the first and second edges being the same and with the length of the third and fourth edges being the same but different from the first and second edges, the first and second shims being positioned next to each other with edges of the same length being in adjacent edge-to-edge relation, and plastic strips separably joining the adjacent edges of the first and second shims.

10. The shims of claim 9, wherein the strips constitute a rigid but separable connection between adjacent shims.

11. The shims of claim 9, wherein there are more than two shims in said plurality of shims, and wherein the shims are interconnected in a sheet and in planar relation to each other.

12. The shims of claim 9 wherein there are more than two shims in said plurality of shims, wherein the shims are interconnected in a sheet and in planar relation to each other, wherein the strips are frangible, and wherein each shim is divided into a plurality of frangible segments.

13. An article of manufacture comprising:

a plurality of elongated hard plastic workpieces, each such workpiece thereby having opposite front and back surfaces, opposite ends, opposite side edges, an elongated thicker section and an elongated tapered thinner section, said workpieces being disposed in generally coplanar relation with the side edges and the end edges parallel to each other and adjacent edges of adjacent workpieces being interconnected along adjacent edges by frangible break lines with the workpieces thereby joined in an assembly but being separable from the assembly singly or in multiples.

14. A plurality of separably interconnected plastic shims, comprising:

first and second plastic shims having side edges positioned adjacent to each other in edge-to-edge relation and also having front and back shimming surfaces extending between the side edges respectively in substantially coplanar relation to each other, and a breakable plastic rib rigidly joining said adjacent edges of the shims and maintaining said substantially coplanar relation of the shimming surfaces along the length of the rib until the shims are broken apart by manually bending the shims relative to each other along the length of the rib.

15. The shims of claim 14, wherein there are more, than two of sail shims with the front and back shimming surfaces of the shims being respectively maintained in substantially coplanar relation along and by breakable ribs interconnecting adjacent edges of adjacent shims, and wherein one or more shims can be separated from the sheet by breaking the rib or ribs connecting the shim or shims being separated.

16. The shims of claim 14, wherein each shim is tapered and has a thicker section and a thinner section, wherein breakable ribs rigidly join the adjacent edges of the thicker sections, and wherein adjacent edges of the thinner sections are not joined throughout substantially their entire lengths.

17. The shims of claim 14, wherein each shim has break lines extending transversely of the shim between the side edges and spaced lengthwise thereof, and wherein the break lines define transverse shim segments that can be broken off from the shim along the break lines.

18. The shims of claim 15, wherein there are longitudinally spaced breakable ribs joining the adjacent edges of adjacent shims in the sheet.

19. The shims of claim 17, wherein corresponding break lines are aligned transversely of the sheet whereby transversely adjacent segments of adjacent shims can be broken off together.

20. The shims of claim 14 wherein the shims are tapered and have thicker and thinner sections, wherein the thinner section of each shim has break lines extending transversely of the shim between the side edges and spaced lengthwise thereof, wherein the break lines define transverse shim segments that can be broken off from the shim along the break lines, and wherein the plastic material and the thickness of the thinner sections enable the thinner sections to be manually flexed together or independently of each other like cantilevers in both directions longitudinally of the shims out of their normal coplanar relation with the thicker sections and the adjacent shim and to return to said coplanar relation without breaking relative to its thicker section or along the break lines.

21. A plurality of separably interconnected plastic shims, comprising:

coplanar, first and second plastic shims having side edges in adjacent face-to-face relation to each other and planar front and back shimming surfaces extending between the side edges and facing outwardly from the shims, and a manually breakable rigid plastic rib projecting from the adjacent side edges and rigidly joining said adjacent side edges of the shims in said face-to-face relation.

* * * * *